US008495944B2

(12) United States Patent
Koide et al.

(10) Patent No.: US 8,495,944 B2
(45) Date of Patent: Jul. 30, 2013

(54) BLAST TREATMENT METHOD AND BLAST TREATMENT DEVICE

(75) Inventors: Kenji Koide, Kobe (JP); Ryusuke Kitamura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 90 days.

(21) Appl. No.: 13/262,245

(22) PCT Filed: Mar. 24, 2010

(86) PCT No.: PCT/JP2010/002062
§ 371 (c)(1),
(2), (4) Date: Sep. 30, 2011

(87) PCT Pub. No.: WO2010/113425
PCT Pub. Date: Oct. 7, 2010

(65) Prior Publication Data

US 2012/0031258 A1 Feb. 9, 2012

(30) Foreign Application Priority Data

Mar. 31, 2009 (JP) ..... 2009-084661

(51) Int. Cl.
*F42D 5/04* (2006.01)

(52) U.S. Cl.
USPC ..... 86/50

(58) Field of Classification Search
USPC ..... 86/50; 588/403, 401, 313, 249.5; 89/1.13
See application file for complete search history.

(56) References Cited

U.S. PATENT DOCUMENTS

| | | | | |
|---|---|---|---|---|
| 4,055,247 | A * | 10/1977 | Benedick et al. | 206/3 |
| 7,398,720 | B2 | 7/2008 | Fujiwara et al. | |
| 8,006,600 | B2 | 8/2011 | Fujiwara et al. | |
| 2009/0131733 | A1 | 5/2009 | Asahina et al. | |
| 2009/0308235 | A1 * | 12/2009 | Lesage et al. | 86/50 |
| 2013/0000469 | A1 * | 1/2013 | Murray | 86/50 |

FOREIGN PATENT DOCUMENTS

| | | |
|---|---|---|
| JP | 2005 291514 | 10/2005 |
| JP | 2007 271136 | 10/2007 |
| JP | 2007 309550 | 11/2007 |
| JP | 2008 14595 | 1/2008 |

OTHER PUBLICATIONS

International Search Report Issued Jul. 13, 2010 in PCT/JP10/002062 filed Mar. 24, 2010.

(Continued)

*Primary Examiner* — Bret Hayes
*Assistant Examiner* — Reginald Tillman, Jr.
(74) *Attorney, Agent, or Firm* — Oblon, Spivak, McClelland, Maier & Neustadt, L.L.P.

(57) ABSTRACT

A blast treatment method for blasting a treatment subject having an outer shell and a chemical agent charged into an interior of the outer shell includes the steps of: disposing an explosive on the outer side of the outer shell such that a difference occurs in a detonation pressure of the explosive, that acts on the outer shell from an outer side, between one side and another side of a predetermined cutting position of the outer shell and the outer shell is cut by a shearing force generated as a result of the difference in the detonation pressure; and detonating the explosive, wherein, in the step of detonating the explosive, the chemical agent is exposed by cutting the outer shell in the cutting position through detonation of the explosive, and the chemical agent is decomposed using the detonation.

7 Claims, 5 Drawing Sheets

OTHER PUBLICATIONS

English Translation of the International Preliminary Report on Patentability with Written Opinion issued Nov. 24, 2011, in International application No. PCT/JP2010/002062.
U.S. Appl. No. 13/262,070, filed Sep. 29, 2011, Koide, et al.
U.S. Appl. No. 13/262,055, filed Sep. 29, 2011, Koide, et al.
U.S. Appl. No. 13/262,419, filed Sep. 30, 2011, Koide, et al.
U.S. Appl. No. 13/262,433, filed Sep. 30, 2011, Fujiwara, et al.
U.S. Appl. No. 13/262,028, filed Sep. 29, 2011, Koide, et al.
U.S. Appl. No. 13/262,448, filed Sep. 30, 2011, Asahina, et al.

* cited by examiner

BLAST TREATMENT METHOD AND BLAST TREATMENT DEVICE

TECHNICAL FIELD

The present invention relates to a blast treatment method and a blast treatment device for treating a treatment subject having an outer shell and a chemical agent charged into an interior of the outer shell.

BACKGROUND ART

Chemical weapons for use by the military, in which a chemical agent harmful to the human body is charged into the interior of a steel outer shell, are available conventionally in the form of artillery shells, bombs, landmines, underwater mines, and so on, for example. A treatment method employing blasting is known as a treatment method for rendering such chemical weapons harmless. When a blast treatment method is used, an operation for dismantling the chemical weapon is not required, and therefore this method can be applied to treat not only well-preserved chemical weapons but also chemical weapons that cannot be dismantled easily due to deterioration over time, deformation, and so on. Another advantage of this method is that substantially all of the chemical agent can be decomposed in an ultra-high temperature field and an ultra-high pressure field generated by an explosion. Patent Document 1 described below, for example, discloses an example of this type of blast treatment method.

In the blast treatment method disclosed in Patent Document 1, chemical ammunition in which an explosive and a chemical agent are housed in an outer shell serves as a treatment subject. ANFO explosive is disposed on an outer periphery of the treatment subject, and a sheet-form explosive having a higher detonation velocity than the ANFO explosive is disposed on an outer periphery of the ANFO explosive. The treatment subject is then blasted by initiating the sheet-form explosive from one axial direction side of the treatment subject such that the ANFO explosive on the inside of the sheet-form explosive explodes in response to detonation of the sheet-form explosive. At this time, the explosive in the interior of the treatment subject also explodes, causing the outer shell of the treatment subject to rupture such that the chemical agent in the interior is exposed. The chemical agent is decomposed and rendered harmless by detonation energy from the respective explosives.

Incidentally, treatment subjects include chemical ammunition in which only a chemical agent is charged into the interior of the outer shell, degraded ammunition in which a burster has deteriorated such that it is difficult to initiate, and so on. When these types of treatment subjects are blasted using the blast treatment method of Patent Document 1, it may be impossible to obtain explosive force from the interior of the treatment subject, or the explosive force from the interior of the treatment subject may be so small that the outer shell of the treatment subject does not rupture sufficiently, and as a result, the chemical agent may not be decomposed sufficiently.

Note that the outer shell may be ruptured sufficiently by increasing an amount of explosive disposed on the outer periphery of the treatment subject, but in this case, a cost increase occurs. Moreover, increases in the amount of explosive are limited due to safety considerations.

Patent Document 1: Japanese Patent Application Publication No. 2005-291514

SUMMARY OF THE INVENTION

An object of the present invention is to provide a blast treatment method and a blast treatment device with which the problems described above are solved.

Another object of the present invention is to provide a blast treatment method and a blast treatment device with which a chemical agent charged into an outer shell of a treatment subject in which only the chemical agent is charged into the outer shell or a treatment subject in which a burster has deteriorated such that it is difficult to initiate can be treated efficiently using a limited amount of explosive.

A blast treatment method according to an aspect of the present invention, for blasting a treatment subject having an outer shell and a chemical agent charged into an interior of the outer shell, includes the steps of: disposing an explosive on the outer side of the outer shell such that a difference occurs in a detonation pressure of the explosive that acts on the outer side of the outer shell between one side and another side of a predetermined cutting position of the outer shell and the outer shell is cut by a shearing force generated as a result of the difference in the detonation pressure; and detonating the explosive, wherein, in the step of detonating the explosive, the chemical agent is exposed by cutting the outer shell in the cutting position through detonation of the explosive, and the chemical agent is decomposed using the detonation.

Further, a blast treatment device according to another aspect of the present invention, for blasting a treatment subject having an outer shell and a chemical agent charged into an interior of the outer shell, includes: an explosive disposed on an outer side of the outer shell in direct contact with an outer surface of the outer shell on only one side of a predetermined cutting position of the outer shell; and an initiation portion that is connected to the explosive to initiate the explosive, wherein the chemical agent is exposed by cutting the outer shell in the cutting position through detonation of the explosive, and the chemical agent is decomposed using the detonation.

EMBODIMENTS FOR CARRYING OUT THE INVENTION

An embodiment of the present invention will be described below with reference to the drawings.

First, referring to FIGS. 1 to 4, a blast treatment method and a blast treatment device according to this embodiment of the present invention will be described.

Figure 1:
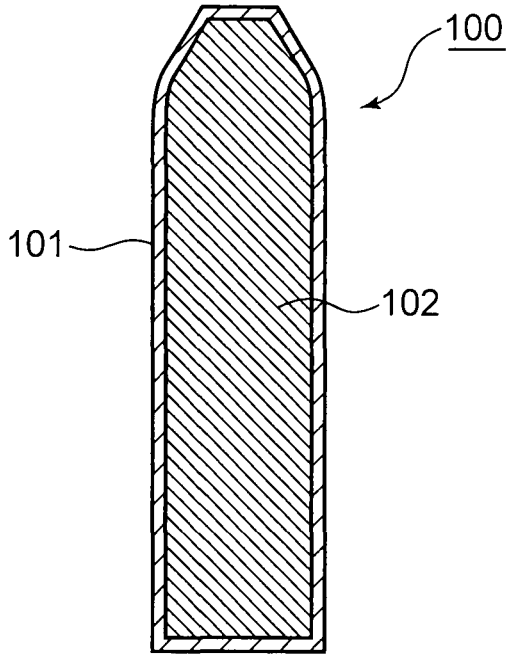
FIG. 1 is a longitudinal sectional view of a treatment subject treated using a blast treatment method according to an embodiment of the present invention.

A treatment subject 100 that is treated using the blast treatment method according to this embodiment is chemical ammunition having an elongated artillery shell-shaped outer form, as shown in FIG. 1. The treatment subject 100 includes a steel shell 101 and a chemical agent 102 harmful to the human body charged into an interior of the shell 101. Note that the shell 101 is included in the concept of an outer shell according to the present invention. The shell 101 has a cylindrical part extending in a predetermined axial direction, and openings at respective axial direction end portions of the cylindrical part are sealed. In the treatment subject 100, an explosive such as a burster is not provided in the shell 101, and therefore the chemical agent 102 is charged into the shell 101 alone.

Figure 2:
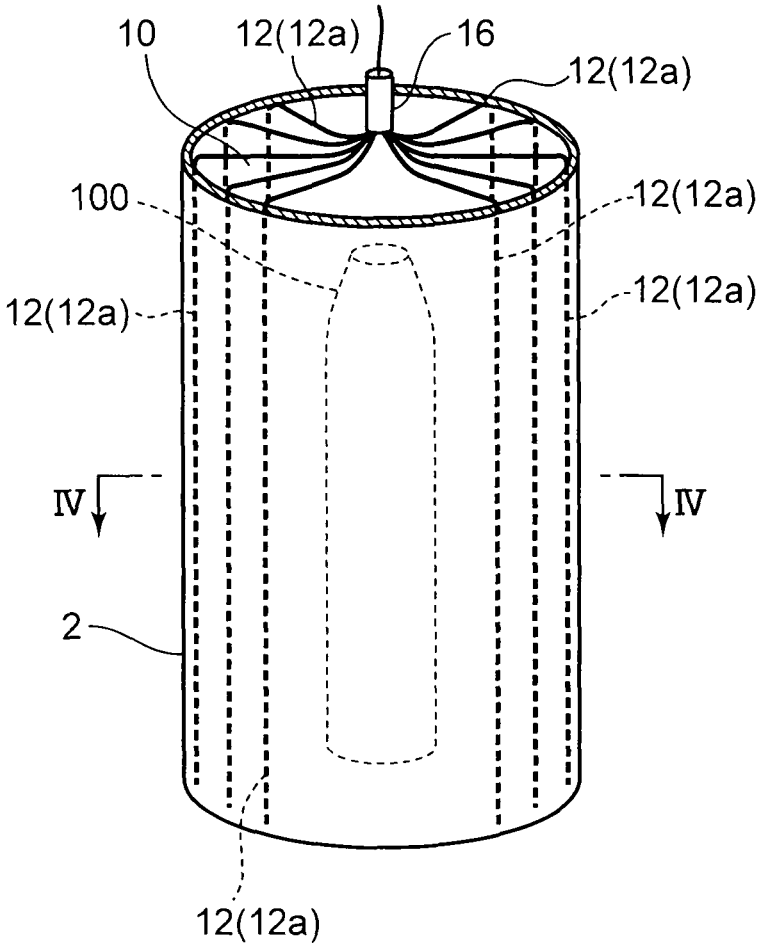
FIG. 2 is a perspective view of a blast treatment device according to this embodiment of the present invention.

In the blast treatment method according to this embodiment, the shell 101 of the treatment subject 100 is cut in a predetermined cutting position by detonating an explosive 6, to be described below, such that the chemical agent 102 is exposed, and the exposed chemical agent 102 is decomposed by the detonation of the explosive 6. In this blast treatment method, a blast treatment device such as that shown in FIG. 2 is manufactured, and the blast treatment device is used to blast the treatment subject 100. In a procedure for manufacturing the blast treatment device, first, a spacer 4 (see FIG. 4) and the explosive 6 are disposed on an outer side of the treatment subject 100 using a container 2.

The container 2 is formed in a closed end cylindrical shape having a bottom wall portion 2*a*.

The spacer 4 is used to define a region for disposing the explosive 6 within an interior space of the container 2 on the periphery of the treatment subject 100. The spacer 4 may be formed by molding foamed polystyrene, another resin material, or the like to have an equal length to the treatment subject 100 in the axial direction of the treatment subject 100 and a substantially fan-shaped cross-section orthogonal to the axial direction.

The explosive 6 is constituted by an inside explosive 10 and an outside explosive 12 disposed on an outer side of the inside explosive 10.

An explosive possessing fluidity is used as the inside explosive 10. Examples of this type of explosive include a particulate explosive such as ANFO explosive, an emulsion explosive, a slurry explosive, and so on.

A plurality of cord-shaped bodies 12*a* formed in a cord shape that extends in a single direction and including an explosive having a higher detonation velocity than a detonation velocity of the inside explosive 10 are used as the outside explosive 12. More specifically, a detonating cord formed by packing an explosive having a higher detonation velocity than the detonation velocity of the inside explosive 10 into a plastic tube, a cord-shaped material formed by incorporating a PETN explosive or the like having a higher detonation velocity than the detonation velocity of the inside explosive 10 into wax, or similar is used as the cord-shaped body 12*a*.

Figure 3:
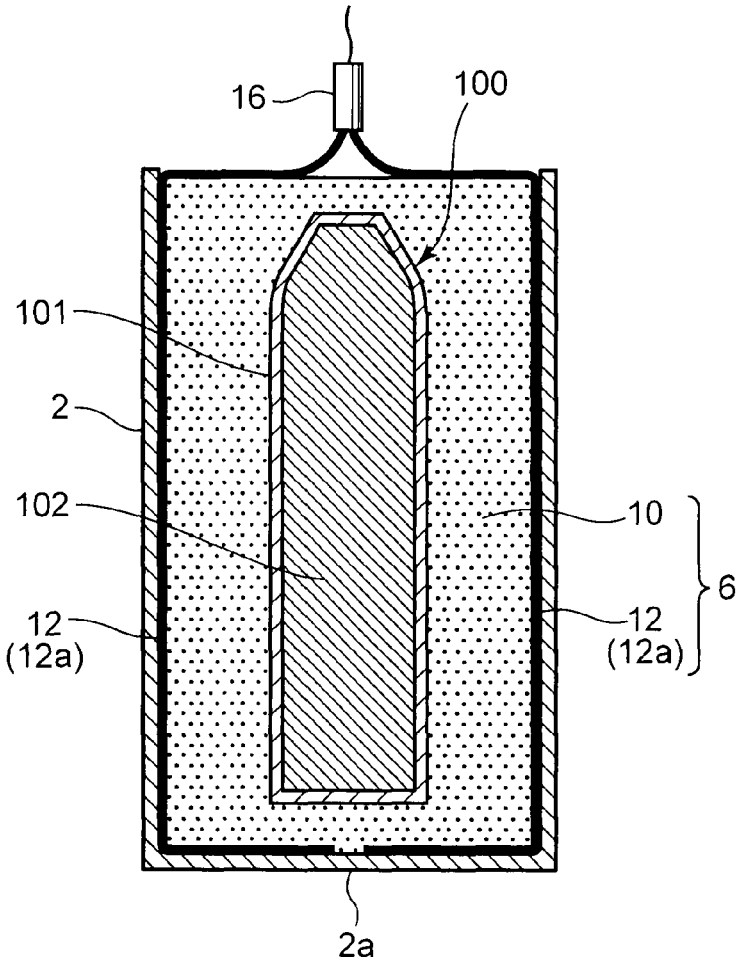
FIG. 3 is a longitudinal sectional view of the blast treatment device shown in FIG. 2.
Figure 4:
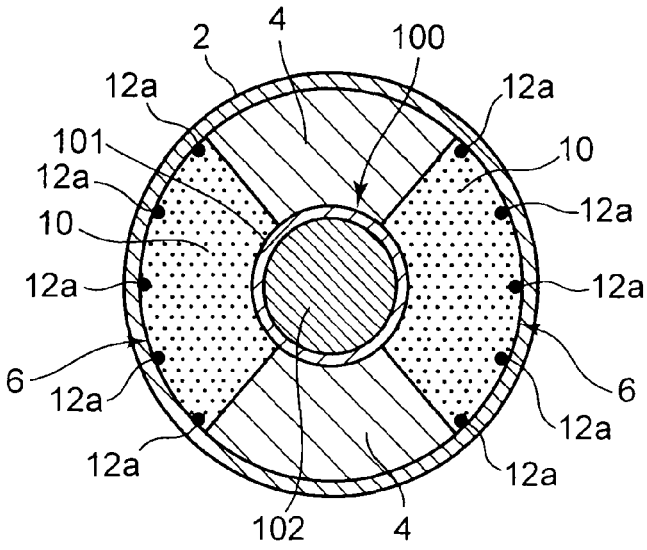
FIG. 4 is a latitudinal sectional view of the blast treatment device shown in FIG. 2, taken along a IV-IV line.

The container 2, the spacer 4, the inside explosive 10, and the outside explosive 12 are then disposed in a following procedure. First, the plurality of cord-shaped bodies 12*a* of the outside explosive 12 are arranged on an inner surface of the container 2. More specifically, as shown in FIG. 3, the cord-shaped bodies 12*a* are attached to the inner surface of the container 2 in the axial direction of the container 2 so as to extend from one end portion to another end portion of the container 2. At this time, the cord-shaped bodies 12*a* are disposed only in a range of the inner surface of the container 2 corresponding to two disposal regions of the inside explosive 10, which are defined subsequently by the spacer 4. As shown in FIG. 4, equal numbers (five in this embodiment) of the cord-shaped bodies 12*a* are disposed in the two regions at equal intervals in a circumferential direction of the container 2.

Next, the treatment subject 100 is disposed in the center of the container 2 so as to be substantially coaxial with the container 2. Further, the spacer 4 is disposed between an outer peripheral surface of the treatment subject 100 and an inner peripheral surface of the container 2. At this time, the spacer 4 is disposed in the container 2 such that an arc-shaped inside surface of the spacer 4 positioned on the treatment subject 100 side closely contacts an outer peripheral surface of the shell 101 of the treatment subject 100 and an arc-shaped outside surface of the spacer 4 opposing the inner peripheral surface of the container 2 closely contacts the inner peripheral surface of the container 2. In this embodiment, a pair of spacers 4, 4 are disposed to sandwich the treatment subject 100 from either side of a radial direction, and the spacers 4, 4 are disposed symmetrically. Thus, the regions for disposing the explosive 6 are formed between the spacers 4, 4 within the space on the outer periphery of the treatment subject 100.

The inside explosive 10 is then charged into the spaces inside the container 2 not occupied by the treatment subject 100 and the pair of spacers 4, 4 such that the inside explosive 10 is disposed on the outer side of the shell 101 of the treatment subject 100 in direct contact with the outer surface of the shell 101. As a result, the inside explosive 10 is disposed symmetrically on either radial direction side of the treatment subject 100, and the cord-shaped bodies 12*a* of the outside explosive 12 are disposed on respective outer sides of the inside explosive 10.

Boundary positions between the inside explosive 10 and the respective spacers 4 serve as cutting positions on the shell 101 of the treatment subject 100 according to this embodiment. The boundaries between the inside explosive 10 and the spacers 4 are formed in four locations on the outer periphery of the treatment subject 100 at predetermined intervals in the circumferential direction, and each boundary is formed to extend in the axial direction of the treatment subject 100. Hence, in this embodiment, the shell 101 of the treatment subject 100 is cut in the axial direction of the treatment subject 100 in four locations on the outer periphery thereof In this embodiment, as described above, the inside explosive 10 is disposed in direct contact with the outer surface of the shell 101 on only one side of each cutting position in the circumferential direction of the shell 101, and the spacers 4 are disposed in direct contact with the outer surface of the shell 101 on the other side of each cutting position. In other words, a region in which the outer surface of the shell 101 is covered by the spacer 4 and the inside explosive 10 does not exist is formed on the other side of each cutting position.

Finally, end portions of all of the cord-shaped bodies 12*a* on an open side of the container 2, or in other words an opposite side to the bottom wall portion 2*a*, are gathered together and connected to a common electric detonator 16. The electric detonator 16 is included in the concept of an initiation unit according to the present invention. Thus, the blast treatment device according to this embodiment is manufactured.

Next, blast treatment is performed on the treatment subject 100 using the blast treatment device manufactured as described above. In the blast treatment, the blast treatment device is housed in the interior of a chamber, not shown in the drawings, and the respective explosives are detonated within the chamber.

In a specific process of the blast treatment, first, all of the cord-shaped bodies 12*a* are initiated and detonated from the end portions thereof by the electric detonator 16. The inside explosive 10 is then initiated from one end portion thereof on the electric detonator 16 side in response to detonation of the cord-shaped bodies 12*a*. The respective cord-shaped bodies 12*a* of the outside explosive 12 are detonated toward an end portion thereof on the opposite side to the electric detonator 16, and the inside explosive 10 is detonated toward the other end portion. Here, the detonation velocity of the cord-shaped bodies 12*a* forming the outside explosive 12 is higher than the detonation velocity of the inside explosive 10, and therefore detonation of the cord-shaped bodies 12*a* advances more quickly than detonation of the inside explosive 10.

When the outside explosive 12 and the inside explosive 10 are detonated, a detonation pressure acts on the shell 101 of the treatment subject 100 from the outer side on one side of the cutting positions, whereas on the other side of the cutting positions, transmission of the detonation pressure is suppressed by the spacers 4. As a result, a difference occurs in the detonation pressure acting on the shell 101 of the treatment subject 100 from the outer side between one side and the other side of the cutting positions.

Further, high-temperature, high-pressure detonation gas is generated upon both detonation of the outside explosive 12 and detonation of the inside explosive 10. In this embodiment, the outside explosive 12 is disposed on the outer side of the inside explosive 10, and therefore the detonation gas that is generated first upon detonation of the outside explosive 12 orients an exertion direction of the detonation gas that is generated subsequently from the inside explosive 10 inwardly in the radial direction and further increases the pressure of the detonation gas from the inside explosive 10. Therefore, the detonation pressure that acts on the shell 101 of the treatment subject 100 from the outer side on one side of the cutting positions increases even further, leading to a further increase in the difference in the detonation pressure acting on the shell 101 of the treatment subject 100 from the outer side between one side and the other side of the cutting positions.

A large shearing force is generated in the cutting positions by the detonation pressure difference. Therefore, even when an explosive force of the respective explosives themselves is comparatively small, the shell 101 of the treatment subject 100 can be cut in the respective cutting positions by the detonation pressure difference. When the shell 101 is cut, the chemical agent 102 charged into the interior of the shell 101 is exposed. The exposed chemical agent 102 is decomposed by the detonation gas and thereby rendered harmless. Thus, the treatment subject 100 is subjected to blast treatment according to this embodiment.

In this embodiment, as described above, an effective shearing force for cutting the shell 101 is generated by the detonation pressure difference between one side and the other side of the cutting positions. Therefore, the shell 101 of the treatment subject 100 can be cut effectively in the cutting positions using the generated shearing force.

Incidentally, in a conventional blast treatment method where an explosive is disposed to cover the entire outer periphery of the treatment subject 100 and the explosive force of the explosive is simply caused to act on the shell 101, the force acting on the shell 101 as a result of the explosion is not concentrated in a cutting position, and it may therefore be difficult to cut the shell 101 effectively. In this embodiment, on the other hand, the shell 101 can be cut effectively in the cutting positions by the shearing force generated as a result of the detonation force difference, as described above. Hence, even when the explosive force of the explosive 6 is weak, the shell 101 of the treatment subject 100 can be cut more easily than with a treatment method in which the explosive force of the explosive is simply caused to act on the shell 101 of the treatment subject 100. Therefore, according to this embodiment, the chemical agent 102 charged into the interior of the shell 101 can be exposed reliably without increasing the amount of explosive, and the exposed chemical agent 102 can be decomposed sufficiently to be rendered harmless by the high-temperature, high-pressure detonation gas generated upon detonation of the explosive 6. As a result, according to this embodiment, the chemical agent 102 charged into the interior of the shell 101 of the treatment subject 100, in which only the chemical agent 102 is charged into the shell 101, can be treated efficiently using a limited amount of explosive.

Further, in this embodiment, the spacers 4 are disposed in the container 2 in direct contact with the outer surface of the shell 101 of the treatment subject 100 on the other side of the cutting positions, whereupon the inside explosive 10 is charged into the spaces inside the container 2 not occupied by the treatment subject 100 and the spacers 4. Hence, according to this embodiment, regions for disposing the inside explosive 10 in direct contact with the outer surface of the shell 101 can be defined inside the container 2 simply by disposing the spacers 4 in the container 2 in direct contact with the outer surface of the shell 101 of the treatment subject 100. As a result, the inside explosive 10 can be disposed in direct contact with the outer surface of the shell 101 of the treatment subject 100 on only one side of the cutting positions easily. Further, detonation transmission is suppressed in the regions where the spacers 4 are disposed, and therefore the detonation of the inside explosive 10 acts on the parts of the shell 101 positioned on one side of the cutting positions but does not act on the parts of the shell 101 positioned on the other side of the cutting positions. As a result, a detonation pressure difference can be generated about the cutting positions of the shell 101.

Furthermore, in this embodiment, the inside explosive 10 is disposed on the outside of the shell 101 of the treatment subject 100 in direct contact with the outer surface of the shell 101 on one side of the cutting positions, and the outside explosive 12 having a higher detonation velocity than the detonation velocity of the inside explosive 10 is disposed on the outside of the inside explosive 10. The outside explosive 12 is then initiated from the end portion thereof, whereupon the inside explosive 10 is detonated from the end portion thereof in response to detonation of the outside explosive 12. Accordingly, the outside explosive 12 having the higher detonation velocity is detonated first on one side of the cutting positions, and the inside explosive 10 is detonated at a relative delay. As a result, the detonation gas generated first upon detonation of the outside explosive 12 orients the detonation gas generated subsequently upon detonation of the inside explosive 10 inwardly in the radial direction and increases the pressure of the inside detonation gas. Hence, the detonation gas acting on the shell 101 of the treatment subject 100 on one side of the cutting positions increases, and therefore the shearing force acting on the shell 101 of the treatment subject 100 in the cutting positions can be increased further. As a result, the shell 101 of the treatment subject 100 can be sheared more reliably in the cutting positions.

Moreover, in this embodiment, the plurality of cord-shaped bodies 12*a* formed in a cord shape that extends in a single direction and including an explosive having a higher detonation velocity than the detonation velocity of the inside explosive 10 are disposed on the outer side of the inside explosive 10 as the outside explosive 12, and therefore the amount of used explosive can be reduced in comparison with a case where a sheet-form explosive having a higher detonation velocity than the detonation velocity of the inside explosive 10 is provided to cover the entire outer side of the inside explosive 10. As a result, according to this embodiment, the amount of explosive can be reduced, leading to a reduction in cost.

Further, in this embodiment, the blast treatment is performed in a chamber, and therefore leakage of the chemical agent 102, scattering of the shell 101 of the blasted treatment subject 100, and so on can be limited to within the chamber so that adverse effects thereof on the external environment can be prevented.

Note that the embodiment disclosed herein is in all respects merely an example and is not to be considered limiting. The scope of the present invention is indicated by the claims rather than the description of the above embodiment, and all modifications within the scope of the present invention and having an equivalent meaning to the claims are included therein.

For example, in the above embodiment, chemical ammunition in which an explosive such as a burster is not provided in the interior of the shell 101 and the chemical agent 102 is charged alone is used as the treatment subject 100, but the present invention is not limited thereto, and the blast treatment method and blast treatment device according to the present invention may also be used to blast a treatment subject other than the chemical ammunition described in the above embodiment. More specifically, chemical ammunition in which a burster and a chemical agent are housed in an outer shell but the burster is deteriorated such that it is difficult to initiate may be treated as a treatment subject using the blast treatment method and blast treatment device according to the present invention. In this type of chemical ammunition, it is very difficult to initiate the burster, and it may therefore be impossible to rupture the outer shell sufficiently with a conventional blast treatment method in which the outer shell is ruptured using internal explosive force. With the blast treatment method and blast treatment device according to the present invention, however, the outer shell can be cut reliably, thereby exposing the chemical agent, even in this type of chemical ammunition, whereupon the chemical agent can be decomposed sufficiently by the detonation gas, as described above.

Furthermore, in the above embodiment, chemical ammunition having an elongated artillery shell-shaped outer form is used as the treatment subject 100, but the present invention is not limited thereto, and the blast treatment method and blast treatment device according to the present invention may be applied to treatment subjects having various outer forms. For example, treatment subjects having a spherical shape, an asymmetrical shape, and various other shapes may be blasted similarly.

Further, in the above embodiment, chemical ammunition is used as the treatment subject 100, but the present invention is not limited thereto, and chemical weapons other than chemical ammunition may be used as treatment subjects. For example, chemical weapons such as landmines and underwater mines may be used as treatment subjects.

Furthermore, in the above embodiment, the plurality of cord-shaped bodies 12*a* are used as the outside explosive 12, but the present invention is not limited thereto, and explosives having various shapes other than a cord shape may be used as the outside explosive. For example, an explosive sheet formed in sheet form and including an explosive having a higher detonation velocity than the detonation velocity of the inside explosive 10 may be used as the outside explosive.

Moreover, in the above embodiment, the spacers 4 having a fan-shaped cross-section are used to define the spaces for disposing the explosive 6 inside the container 2, but the present invention is not limited to this constitution. For example, partition walls may be provided at respective end portions of the disposal regions for the explosive 6 in the circumferential direction of the container 2 such that the partition walls serve as the spacers of the present invention. In this case, the regions sandwiched between the partition walls form spaces in which nothing is disposed.

Figure 5:
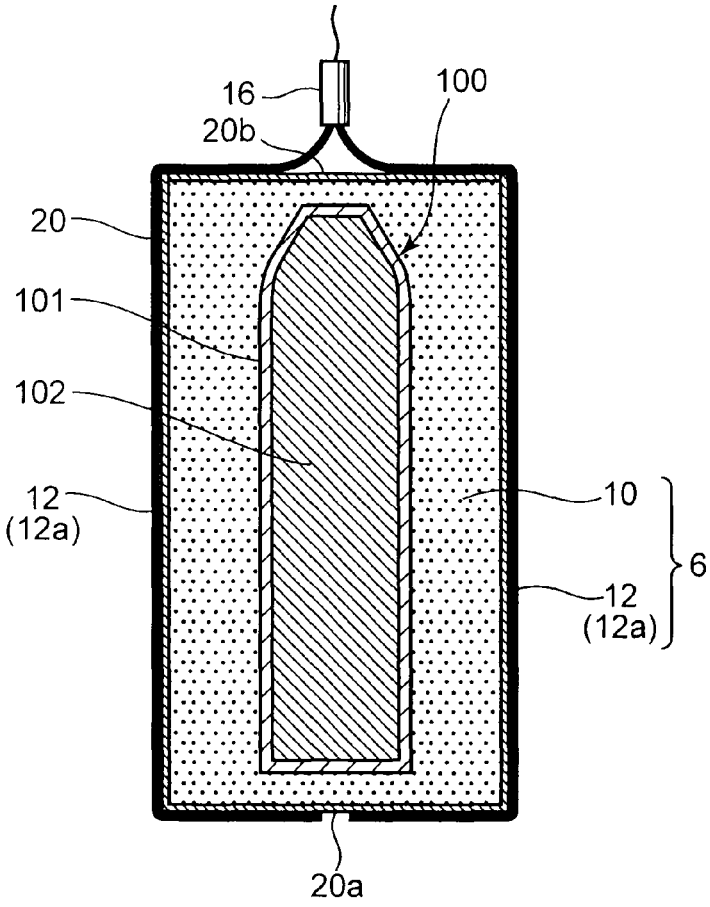
FIG. 5 is a longitudinal sectional view of a blast treatment device according to a first modified example of this embodiment of the present invention.
Figure 6:
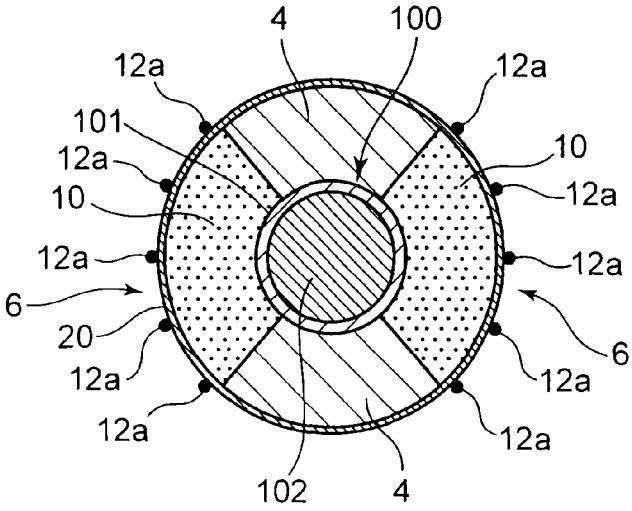
FIG. 6 is a latitudinal sectional view of the blast treatment device according to the first modified example, shown in FIG. 5, corresponding to FIG. 4.

Further, in the above embodiment, the outside explosive 12 is disposed on the outer side of the inside explosive 10 by disposing the outside explosive 12 on the inner surface of the container 2 and charging the inside explosive 10 into the interior space of the container 2, but the present invention is not limited to this constitution. For example, according to a first modified example of the first embodiment shown in FIGS. 5 and 6, the outside explosive 12 may be disposed on the outer side of the inside explosive 10 by charging the inside explosive 10 into a container 20 and disposing the outside explosive 12 on an outer surface of the container 20.

In the first modified example, the container 20 is formed in a cylindrical shape having a bottom wall portion 20*a* and a detachable ceiling wall portion 20*b*. The container 20 is formed from a material that ruptures when the outside explosive 12 is detonated and does not prevent the detonation of the outside explosive 12 from being transmitted to the inside explosive 10.

In a procedure for disposing the treatment subject 100, the spacers 4, the inside explosive 10, and the outside explosive 12 according to the first modified example, first, the treatment subject 100 is disposed in the center of the interior space of the container 20 so as to be substantially coaxial with the container 20 while the ceiling wall portion 20*b* of the container 20 is detached, whereupon the pair of spacers 4, 4 are disposed symmetrically so as to sandwich the treatment subject 100 in the radial direction. The spacers 4, 4 are disposed in direct contact with the outer surface of the shell 101 of the treatment subject 100. The inside explosive 10 is then charged into the spaces inside the container 20 not occupied by the treatment subject 100 and the pair of spacers 4, 4. An opening portion of the container 20 on the opposite side to the bottom wall portion 20*b* is then closed by the ceiling wall portion 20*b*.

Next, the cord-shaped bodies 12*a* of the outside explosive 12 are attached to the outer surface of the container 20 so as to extend from one end portion to the other end portion of the container 20 in the axial direction. At this time, the cord-shaped bodies 12*a* are disposed only in a range of the outer surface of the container 20 positioned on the outer side of the disposal regions of the inside explosive 10, and the cord-shaped bodies 12*a* are not disposed in ranges positioned on the outer side of the respective spacers 4. Thus, the inside explosive 10 and the spacers 4 are disposed in direct contact with the outer surface of the shell 101 of the treatment subject 100 and separated to either side so as to sandwich the cutting positions, while the outside explosive 12 is disposed on the outer side of the inside explosive 10. All other constitutions of the first modified example are similar to the constitutions of the above embodiment.

Further, in the first modified example, various types of container may be used as the container 20 as long as the inside explosive 10 can be charged therein and as long as the container ruptures when the outside explosive 12 is detonated and does not prevent the detonation of the outside explosive 12 from being transmitted to the inside explosive 10. For example, a plastic container, a container formed from various materials other than plastic, a sheet or a bag made of plastic resin, and so on may be used as the container 20.

Furthermore, in the above embodiment, the shell 101 of the treatment subject 100 is cut along the axial direction thereof, but the present invention is not limited thereto. In other words, the shell 101 of the treatment subject 100 may be cut in any direction other than the aforesaid direction, and cutting sites of the shell 101 may be set in any locations other than those described above.

Figure 7:
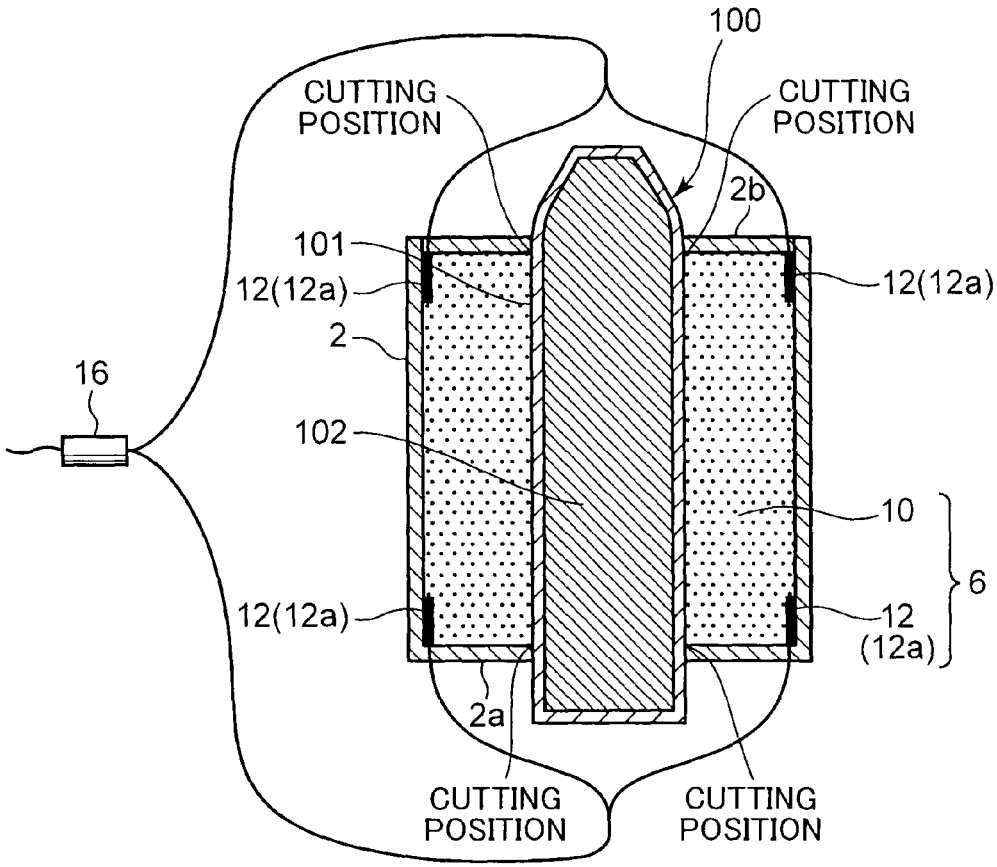
FIG. 7 is a longitudinal sectional view of a blast treatment device according to a second modified example of this embodiment of the present invention.

For example, in a second modified example of the above embodiment, shown in FIG. 7, the shell 101 of the treatment subject 100 may be cut in an orthogonal direction to the axial direction in two different axial direction locations. More specifically, in the second modified example, the cutting positions of the shell 101 of the treatment subject 100 are set in two different locations in the axial direction of the shell 101 and extend around the entire periphery of the shell 101. Further, in the second modified example, a container having a smaller axial direction length than an axial direction length of the treatment subject 100 is used as the container 2. Through holes having a substantially equal inner diameter to a diameter of the treatment subject 100 are formed in the bottom wall portion 2*a* and a ceiling wall portion 2*b* of the container 2. When the ceiling wall portion 2*b* is detached from the container 2, the treatment subject 100 is inserted into the container 2 and passed through the through hole in the bottom wall portion 2*a* so that one end portion of the treatment subject 100 projects outwardly from the bottom wall portion 2*a*. The plurality of cord-shaped bodies 12*a* of the outside explosive 12 are then disposed in a part of the inner peripheral surface of the container 2 near the bottom wall portion 2*a* and a part of the inner peripheral surface of the container 2 near an opening portion on the opposite side to the bottom wall portion 2*a*. At this time, the cord-shaped bodies 12*a* are disposed close to each other at equal circumferential direction intervals around the entire periphery of the inner peripheral surface of the container 2.

Next, the inside explosive 10 is charged into the space inside the container 2 not occupied by the treatment subject 100, whereupon the opening portion of the container 2 is closed by the ceiling wall portion 2*b*. At this time, the other end portion of the treatment subject 100 is passed through the through hole in the ceiling wall portion 2*b* such that the other end portion of the treatment subject 100 projects to the outside through the ceiling wall portion 2*b*. In the second modified example, a boundary position between a region of the shell 101 of the treatment subject 100 that is covered by the inside explosive 10 and an uncovered region serves as the cutting position of the shell 101. In other words, in the second modified example, the explosive 6 is disposed in direct contact with the outer surface of the shell 101 only on a central portion side in the axial direction of the shell 101 relative to the cutting positions of the shell 101.

Finally, the plurality of cord-shaped bodies 12*a* disposed on the ceiling wall portion 2*b* side are gathered together and the plurality of cord-shaped bodies 12*a* disposed on the bottom wall portion 2*a* side are gathered together. The gathered cord-shaped bodies 12*a* on the ceiling wall portion 2*b* side and the bottom wall portion 2*a* side are then respectively connected to the common electric detonator 16.

The outside explosive 12 and inside explosive 10 of the blast treatment device manufactured in this manner are then detonated. As a result, detonation pressure acts on the part of the shell 101 on the central portion side in the axial direction of the shell 101 relative to the cutting position from a radial direction outer side toward a radial direction inner side, but no detonation pressure acts on a part of the shell 101 on an end portion side (an outer side) of the axial direction of the shell 101 relative to the cutting position. Shearing force is generated by the resulting difference in the detonation pressure acting on the shell 101, and the shell 101 is cut in the cutting position in an orthogonal direction to the axial direction by the shearing force.

Incidentally, sealed parts in the two axial direction end portions of the shell 101 have comparatively high rigidity, whereas the rigidity of an inside part in the axial direction of the shell 101 is comparatively low. Therefore, by disposing the explosive 6 in direct contact with the outer surface of the shell 101 only on the central portion side in the axial direction of the shell 101 relative to the cutting position that extends around the entire periphery of the shell 101 in a predetermined axial direction position of the shell 101, as in the second modified example, detonation pressure can be exerted on the part of the shell 101 having comparatively low rigidity from the radial direction outer side, and as a result, this part can be ruptured easily. Hence, in the second modified example, when the shell 101 of the treatment subject 100 has a cylindrical part extending in a predetermined axial direction and openings in the respective axial direction end portions of the cylindrical part are sealed, the shell 101 can be sheared easily in the cutting position.

Figure 8:
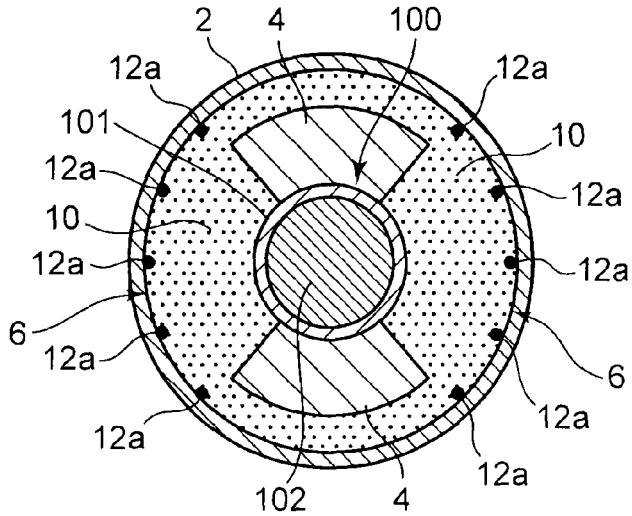
FIG. 8 is a latitudinal sectional view of a blast treatment device according to a third modified example of this embodiment of the present invention.

Further, in the above embodiment, the spacers 4 are provided in the container 2 in contact with the outer surface of the shell 101 of the treatment subject 100 and in contact with the inner peripheral surface of the container 2, but the present invention is not limited thereto. In a third modified example shown in FIG. 8, spacers 4 having a smaller dimension in the radial direction of the treatment subject 100 than the spacers 4 according to the above embodiment may be disposed in the container 2 such that a gap is formed between the arc-shaped outside surface of the spacers 4 and the inner peripheral surface of the container 2. Note, however, that likewise in the third modified example, the arc-shaped inside surface of the spacers 4 in the radial direction of the treatment subject 100 directly contact the outer surface of the shell 101 of the treatment subject 100, similarly to the above embodiment. In the third modified example, boundary positions between end surfaces of the spacers 4 and the inside explosive 10 in the circumferential direction of the treatment subject 100 serve as the cutting positions of the shell 101. Note that in the third modified example, when the inside explosive 10 is charged into the container 2, the inside explosive 10 is charged not only into the space between the two spacers 4, but also into a gap between the outside surfaces of the spacers 4 and the inner peripheral surface of the container 2. The inside explosive 10 charged into the gap is also detonated during blasting of the treatment subject 100, but transmission of this detonation to the radial direction inner side is suppressed by the spacers 4. Accordingly, the detonation reaches the parts of the shell 101 contacted by the spacers 4 at a delay. As a result, when the detonation of the inside explosive 10 disposed between the two spacers 4 acts on the shell 101, a difference occurs in the detonation pressure exerted on the shell 101 from the radial direction outer side between one side and the other side of the cutting positions of the shell 101, and the shell 101 is sheared by a shearing force generated due to the detonation pressure difference.

Outline of Embodiments

The embodiment and modified examples described above can be summarized as follows.

The blast treatment method according to the embodiment and modified examples described above is a method for blasting a treatment subject having an outer shell and a chemical agent charged into an interior of the outer shell, including the steps of: disposing an explosive on the outer side of the outer shell such that a difference occurs in a detonation pressure of the explosive, that acts on the outer shell from an outer side, between one side and another side of a predetermined cutting position of the outer shell and the outer shell is cut by a shearing force generated as a result of the difference in the detonation pressure; and detonating the explosive, wherein, in the step of detonating the explosive, the chemical agent is exposed by cutting the outer shell in the cutting position through detonation of the explosive, and the chemical agent is decomposed using the detonation.

In this blast treatment method, an effective shearing force for cutting the outer shell of the treatment subject can be generated by the difference in detonation pressure generated between one side and the other side of the cutting position, and using this generated shearing force, the outer shell of the treatment subject can be cut effectively in the cutting position. As a result, with this blast treatment method, the outer shell of the treatment subject can be cut more easily than with a treatment method of simply applying an explosive force of an explosive to the outer shell of the treatment subject, even when the explosive force of the explosive is weak. Hence, with this blast treatment method, the chemical agent charged into the interior of the outer shell can be exposed reliably without increasing the amount of explosive, and the exposed chemical agent can be decomposed sufficiently to be rendered harmless by the high-temperature, high-pressure detonation gas generated through detonation of the explosive. Therefore, with this blast treatment method, a chemical agent charged into an outer shell of a treatment subject in which only the chemical agent is charged into the outer shell, or a treatment subject in which a burster has deteriorated such that it is difficult to initiate, can be treated efficiently using a limited amount of explosive.

In the blast treatment method described above, the step of disposing the explosive on the outer side of the outer shell preferably includes a step of disposing the explosive in direct contact with an outer surface of the outer shell on only one side of the cutting position.

With this constitution, detonation pressure acts directly on the outer shell of the treatment subject from the outer side on only one side of the cutting position, and therefore a difference in the detonation pressure acting on the outer shell of the treatment subject from the outer side can be generated between one side and the other side of the cutting position.

In this case, the step of disposing the explosive on only one side of the cutting position preferably includes the steps of: disposing the treatment subject inside a container; disposing a spacer in direct contact with the outer surface of the outer shell of the treatment subject on the other side of the cutting position; and charging the explosive into a space inside the container not occupied by the treatment subject and the spacer.

With this constitution, the explosive is charged into a region of the space inside the container on one side of the cutting position but not charged into a region of the space inside the container in which the spacer is disposed, on the other side of the cutting position. In other words, with this constitution, a region in which the explosive is disposed in direct contact with the outer surface of the outer shell of the treatment subject can be defined in the container simply by disposing the spacer in the container in direct contact with the outer surface of the outer shell. As a result, the explosive can be disposed in direct contact with the outer surface of the outer shell of the treatment subject on only one side of the cutting position easily. Further, in the spacer disposal region, detonation transmission is suppressed, and therefore, when a detonation acts on the part of the outer shell of the treatment subject positioned on one side of the cutting position, the detonation does not act on the part of the outer shell positioned on the other side of the cutting position. As a result, a detonation pressure difference can be generated about the cutting position of the outer shell.

In the constitution including the step of disposing the explosive described above, the outer shell of the treatment subject may include a cylindrical part extending in a predetermined axial direction, openings in respective axial direction end portions of the cylindrical part being sealed, the cutting position may extend around an entire periphery of the outer shell in a predetermined position in the axial direction of the outer shell, and in the step of disposing the explosive on only one side of the cutting position, the explosive may be disposed in direct contact with the outer surface of the outer shell on only a central portion side in the axial direction of the outer shell relative to the cutting position.

The parts where the openings in the two axial direction end portions of the outer shell are sealed have comparatively high rigidity, whereas the rigidity of the inside part in the axial direction of the outer shell is comparatively low. Therefore, by disposing the explosive in direct contact with the outer surface of the outer shell only on the central portion side in the axial direction of the outer shell relative to the cutting position extending around the entire periphery of the outer shell in a predetermined axial direction position of the outer shell, as in this constitution, the detonation pressure of the explosive can be exerted on the part of the outer shell having comparatively low rigidity from the radial direction outer side, and as a result, this part can be ruptured easily. Hence, with this constitution, when the outer shell of the treatment subject has a cylindrical part extending in a predetermined axial direction and the openings in the respective axial direction end portions of the cylindrical part are sealed, the outer shell of the treatment subject can be sheared easily in the cutting position.

In the constitution including the step of disposing the explosive described above, the step of disposing the explosive on only one side of the cutting position preferably includes the steps of: disposing an inside explosive in direct contact with the outer surface of the outer shell on the one side of the cutting position; and disposing an outside explosive having a higher detonation velocity than a detonation velocity of the inside explosive on an outer side of the inside explosive, and in the step of detonating the explosive, the outside explosive is preferably initiated such that through detonation of the outside explosive, the inside explosive is detonated.

With this constitution, the outside explosive having the higher detonation velocity is detonated first on one side of the cutting position, and the inside explosive is detonated at a relative delay. As a result, the detonation gas generated first upon detonation of the outside explosive orients the detonation gas generated subsequently upon detonation of the inside explosive inwardly and increases the pressure of the inside detonation gas. Hence, the detonation pressure acting on the outer shell of the treatment subject on one side of the cutting positions increases, and therefore the difference in the detonation pressure acting on the outer shell of the treatment subject from the outer side between one side and the other side of the cutting position can be enlarged. Accordingly, the shearing force acting on the outer shell of the treatment subject in the cutting position can be increased further, and as a result, the outer shell of the treatment subject can be sheared more reliably in the cutting position.

In this case, in the step of disposing the outside explosive, a cord-shaped body that is formed in a cord shape extending in a single direction and includes an explosive having a higher detonation velocity than the detonation velocity of the inside explosive is preferably disposed on the outer side of the inside explosive.

By employing a cord-shaped body, as in this constitution, the amount of used explosive can be reduced in comparison with a case where the entire outer side of the inside explosive is covered by a sheet-form explosive having a higher detonation velocity than the detonation velocity of the inside explosive. Therefore, with this constitution, the amount of explosive can be reduced, enabling a reduction in cost.

In the blast treatment method described above, the step of detonating the explosive is preferably performed in a chamber.

With this constitution, leakage of the chemical agent, scattering of the outer shell of the blasted treatment subject, and so on can be limited to within the chamber so that adverse effects thereof on the external environment can be prevented.

Further, the blast treatment device according to the embodiment and the modified examples described above is a device for blasting a treatment subject having an outer shell and a chemical agent charged into an interior of the outer shell, including: an explosive disposed on an outer side of the outer shell in direct contact with an outer surface of the outer shell on only one side of a predetermined cutting position of the outer shell; and an initiation portion that is connected to the explosive to initiate the explosive, wherein the chemical agent is exposed by cutting the outer shell in the cutting position through detonation of the explosive, and the chemical agent is decomposed using the detonation.

In this blast treatment device, the explosive is initiated by the initiation portion such that the detonation pressure of the explosive can be caused to act on the outer shell of the treatment subject from the outer side on only one side of the cutting position, and therefore a difference in the detonation pressure acting on the outer shell of the treatment subject from the outside can be generated between one side and the other side of the cutting position. Using this detonation pressure difference, an effective shearing force for cutting the outer shell can be generated in the cutting position, and using the shearing force, the outer shell of the treatment subject can be cut effectively in the cutting position. Hence, with this blast treatment device, the outer shell of the treatment subject can be cut more easily than with a treatment device in which the explosive force of the explosive is simply caused to act on the outer shell of the treatment subject, even when the explosive force of the explosive is weak. Therefore, with this blast treatment device, the chemical agent charged into the interior of the outer shell can be exposed reliably without increasing the amount of explosive, and the exposed chemical agent can be decomposed sufficiently to be rendered harmless by the high-temperature, high-pressure detonation gas generated upon detonation of the explosive. As a result, with this blast treatment device, a chemical agent charged into an outer shell of a treatment subject in which only the chemical agent is charged into the outer shell, or a treatment subject in which a burster has deteriorated such that it is difficult to initiate, can be treated efficiently using a limited amount of explosive.

The blast treatment device described above preferably further includes: a container inside which the treatment subject is accommodated; and a spacer disposed in the container in direct contact with the outer surface of the outer shell of the treatment subject on another side of the cutting position, wherein the explosive is preferably charged into a space inside the container not occupied by the treatment subject and the spacer.

With this constitution, a region in which the explosive is disposed in direct contact with the outer surface of the outer shell of the treatment subject can be defined in the container simply by disposing the spacer in the container in direct contact with the outer surface of the outer shell of the treatment subject. As a result, the explosive can be disposed in direct contact with the outer surface of the outer shell of the treatment subject on only one side of the cutting position easily. Further, in the spacer disposal region, detonation transmission is suppressed, and therefore, when a detonation acts on the part of the outer shell of the treatment subject positioned on one side of the cutting position, the detonation does not act on the part of the outer shell positioned on the other side of the cutting position. As a result, a detonation pressure difference can be generated about the cutting position of the outer shell.

In the blast treatment device described above, the explosive preferably includes an inside explosive disposed in direct contact with the outer surface of the outer shell on the one side of the cutting position, and an outside explosive disposed on an outer side of the inside explosive and having a higher detonation velocity than a detonation velocity of the inside explosive, and the initiation portion is preferably connected to the outside explosive.

With this constitution, when the outside explosive is initiated by the initiation portion, the outside explosive having the higher detonation velocity is detonated first on one side of the cutting position, and the inside explosive, which is initiated in response to detonation of the outside explosive, is detonated at a delay. As a result, the detonation gas generated first upon detonation of the outside explosive orients the detonation gas generated subsequently upon detonation of the inside explosive inwardly and increases the pressure of the inside detonation gas. Hence, the detonation gas acting on the outer shell of the treatment subject on one side of the cutting positions increases, and therefore the difference in the detonation pressure acting on the outer shell of the treatment subject from the outer side between one side and the other side of the cutting position can be enlarged. Accordingly, the shearing force acting on the outer shell of the treatment subject in the cutting position can be increased further, and as a result, the outer shell of the treatment subject can be sheared more reliably in the cutting position.

According to the embodiment and the modified examples described above, a chemical agent charged into an outer shell of a treatment subject in which only the chemical agent is charged into the outer shell, or a treatment subject in which a burster has deteriorated such that it is difficult to initiate, can be treated efficiently using a limited amount of explosive.

The invention claimed is:

1. A blast treatment method for blasting a treatment subject having an outer shell and a chemical agent charged into an interior of the outer shell, comprising the steps of:

disposing an explosive on the outer side of the outer shell of a treatment subject the outer shell such that a difference occurs in a detonation pressure of the explosive that acts on the outer shell from an outer side between one side and another side of a predetermined cutting position of the outer shell and the outer shell is cut by a shearing force generated as a result of the difference in the detonation pressure; and detonating the explosive, wherein, in the step of detonating the explosive, the chemical agent is exposed by cutting the outer shell in the cutting position through detonation of the explosive, and the chemical agent is decomposed using the detonation.

2. The blast treatment method according to claim 1, wherein the step of disposing the explosive on the outer side of the outer shell includes a step of disposing the explosive in direct contact with an outer surface of the outer shell on only one side of the cutting position.

3. The blast treatment method according to claim 2, wherein the step of disposing the explosive on only one side of the cutting position includes the steps of:

disposing the treatment subject inside a container;

disposing a spacer in direct contact with the outer surface of the outer shell of the treatment subject on the other side of the cutting position; and charging the explosive into a space inside the container not occupied by the treatment subject and the spacer.

4. The blast treatment method according to claim 2, wherein the outer shell of the treatment subject includes a cylindrical part extending in a predetermined axial direction, openings in respective axial direction end portions of the cylindrical part being sealed, the cutting position extends around an entire periphery of the outer shell in a predetermined position in the axial direction of the outer shell, and in the step of disposing the explosive on only one side of the cutting position, the explosive is disposed in direct contact with the outer surface of the outer shell on only a central portion side in the axial direction of the outer shell relative to the cutting position.

5. The blast treatment method according to claim 2, wherein the step of disposing the explosive on only one side of the cutting position includes the steps of:

disposing an inside explosive in direct contact with the outer surface of the outer shell on the one side of the cutting position; and disposing an outside explosive having a higher detonation velocity than a detonation velocity of the inside explosive on an outer side of the inside explosive, and in the step of detonating the explosive, the outside explosive is initiated such that through detonation of the outside explosive, the inside explosive is detonated.

6. The blast treatment method according to claim 5, wherein in the step of disposing the outside explosive, a cord-shaped body that is formed in a cord shape extending in a single direction and includes an explosive having a higher detonation velocity than the detonation velocity of the inside explosive is disposed on the outer side of the inside explosive.

7. The blast treatment method according to claim 1, wherein the step of detonating the explosive is performed in a chamber.

* * * * *